US005364266A

United States Patent [19]

Andrews

[11] Patent Number: 5,364,266

[45] Date of Patent: Nov. 15, 1994

[54] METHOD AND APPARATUS FOR INCREASING FURNACE CAPACITY

[75] Inventor: Bradley C. Andrews, Parma, Ohio

[73] Assignee: Metal Processing Corporation, Maple Heights, Ohio

[21] Appl. No.: 167,566

[22] Filed: Dec. 14, 1993

[51] Int. Cl.[5] ..... C21D 9/00

[52] U.S. Cl. ..... 432/254.1; 432/254.2; 432/260

[58] Field of Search ..... 432/205, 206, 207, 208, 432/209, 183, 251, 254.1, 257.2, 260

[56] References Cited

U.S. PATENT DOCUMENTS

| | | | |
|---|---|---|---|
| 3,081,074 | 3/1963 | Blackman et al. | 432/260 |
| 3,386,721 | 6/1968 | Jones et al. | 432/260 |
| 3,802,834 | 4/1974 | Corbett, Jr. | 432/260 |
| 3,971,875 | 7/1976 | Regalbuto | 432/205 |
| 3,975,145 | 8/1976 | Hill et al. | 432/260 |
| 4,165,868 | 8/1979 | Southern | 432/254.2 |
| 5,207,573 | 5/1993 | Miyagi et al. | 432/253 |

*Primary Examiner*—Henry C. Yuen
*Attorney, Agent, or Firm*—Calfee, Halter & Griswold

[57] ABSTRACT

The present invention provides an inexpensive furnace modification which increases the productivity of the furnaces without requiring extensions to the furnace member or the surrounding building. Existing inner covers are extended a predetermined amount to accommodate the additional steel product within the volume defined by the inner cover. This is done by either adding a section to an existing inner cover, or by providing new covers of increased height. A ring structure of the predetermined additional height required and having the same diameter as the furnace member is placed over the inner cover and positioned to rest on the furnace base so that it encircles a portion of the inner cover. The furnace member is then placed over the inner cover and positioned to rest on the ring. Preferably, both the ring and the furnace member have annular locating lugs which coact with locating posts adjacent the base. As a result, in order to place or remove the furnace member it needs to be raised above the floor by the same amount that the inner cover height has been increased and not by twice that amount which would be required if this height were added to the furnace member. As a result, the furnace member fits over the extended inner cover, and thus, the additional height available above the furnace need only be the same distance as the height of the inner cover extension.

20 Claims, 4 Drawing Sheets

METHOD AND APPARATUS FOR INCREASING FURNACE CAPACITY

BACKGROUND OF THE INVENTION

Radiant tube, electric, or open flame furnace installations are used to heat steel products to anneal the steel. These furnace installations comprise a base, an inner cover and a furnace member. Typically the steel product, such as, for example, steel rod, bar, wire or strip are loaded on the furnace base. The furnace base is typically fixed in the ground and set at or below floor level. Next, the inner cover is placed over the steel rod or coil. Typically the inner cover is lifted over the steel rod by overhead travelling cranes. Once the inner cover is aligned over the load, the inner cover is then slowly lowered until it rests on the furnace base. Some type of gas tight seal is typically provided between the inner cover and the base so that the atmosphere within the inner cover can be controlled by the introduction of specific gases or mixture of gases.

The furnace member, which contains the heating elements, is then lifted above the inner cover and aligned with the inner cover. Then the furnace member is lowered until it rests on the base. Guide posts are often provided which coact with an annular lug on the furnace to assist proper alignment of the furnace. Once positioned, the furnace member encloses the inner cover. Thereafter, the load is heated to the desired temperature by means of the heating elements in the furnace member.

After heating and soaking at the desired temperature, which is controlled by thermocouples, the furnace member is removed. After the load has cooled to below a desired temperature, the inner cover is lifted vertically until its lower edge clears the steel load and then moved.

The productivity of the furnace, that is, the amount of steel rod or coil that can be heated at one time, is limited by the interior volume under the inner cover. Thus, by increasing the height of the inner cover, one can increase the volume under the inner cover to permit more steel to be heated during a given heating run. To accomplish this, an inner cover may readily be heightened by cutting the cover and welding in an annular section. Alternatively, a new, taller cover may be provided. However, once the inner cover is heightened the original furnace member will no longer fit over the inner cover.

If one has unlimited financial resources, a new, taller, furnace member of suitable height may be purchased to fit over the heightened inner cover. Unfortunately, a furnace member is quite expensive to replace. Alternatively, one may extend the height of an existing furnace member by an amount corresponding to the increased height of the inner cover. However, the cost of modifying a furnace member by adding to either the top or bottom of the furnace member is considerable. In addition, the furnace member is out of service while it is being modified.

More importantly, the physical limitations of the space surrounding the furnace, that is the ceiling height or the overhead crane height often renders this option impossible. For example, if the inner cover is extended by twelve inches, then twelve inches must be added to the height of the furnace member in order for the furnace member to fit over the inner cover. However, when the extended furnace member is emplaced or removed, in order for it to clear the extended inner cover, there must be sufficient space between the top of the furnace member and the overhead crane. That is, the space above the furnace must accommodate not only the original height of the furnace member along with the original safe clearance between the bottom edge of the furnace member and the top edge of the inner cover, but the space must also accommodate the 12 inch extension to the furnace member and the 12 inch extension to the inner cover. Thus, there must be at least two additional feet (24 inches) of space available in which to raise the extended furnace member so that it may clear the inner cover. Expressed another way, for each inch of height added to the inner cover height, there must be available two additional inches of height between the top of the furnace member and the crane. That is, there must be a 2:1 ratio of available space to additional inner cover height. In many facilities, such vertical space above the furnaces is not available. Raising the roof of the building that houses the furnace, together with the crane is prohibitively expensive.

Accordingly, it is desirable to increase the quantity of steel heated in the furnace without raising the ceiling or overhead crane and without modification to the furnace member.

SUMMARY OF THE INVENTION

The present invention provides an inexpensive furnace modification which increases the productivity of radiant furnaces without requiring extensions to the furnace member or the surrounding building. The height of an existing inner cover is extended a predetermined amount to accommodate the additional steel product within the volume defined by the inner cover. This is done by either adding a section to an existing inner cover, or by providing new covers of increased height.

A novel ring structure having the same height as the predetermined additional height of the inner cover, and having the same diameter as the furnace member, is placed over the inner cover and positioned to rest on the furnace base so that it encircles a portion of the inner cover. The furnace member is then placed over the inner cover and positioned to rest on the ring. As a result, the inner cover is completely enclosed. Preferably, both the ring and the furnace member have annular locating lugs which coact with locating posts adjacent the base.

Hence, in order to place or remove the furnace member it needs to be raised above the floor by the same amount that the inner cover height has been increased and not by twice that amount which would be required if this height were added to the furnace member. As a result, the furnace member fits over the extended inner cover, yet, the additional height available above the furnace need only be the same distance as the height of the inner cover extension.

DETAILED DESCRIPTION OF THE INVENTION

The present invention provides an inexpensive radiant furnace modification which increases or maximizes the productivity of radiant furnace installations without requiring extensions to the furnace member or the surrounding building. New covers are modified or existing inner covers are configured or extended a predetermined amount to accommodate the additional steel product that can be accommodated below the inner cover.

In essence, the present invention incorporates a ring structure of the same predetermined height as the inner cover has been increased and which has the same diameter as the furnace member. The ring is placed over the inner cover and positioned to rest on the furnace base or floor so that it encircles a portion of the inner cover. The furnace member is then placed over the inner cover and positioned to rest on the ring. Hence, the furnace member is raised above the floor by the same amount that the inner cover height has been increased. As a result the furnace member fits over the extended inner cover. Moreover, the additional space available above the furnace need only be the same distance as the inner cover extension as will be explained presently.

Figure 1:
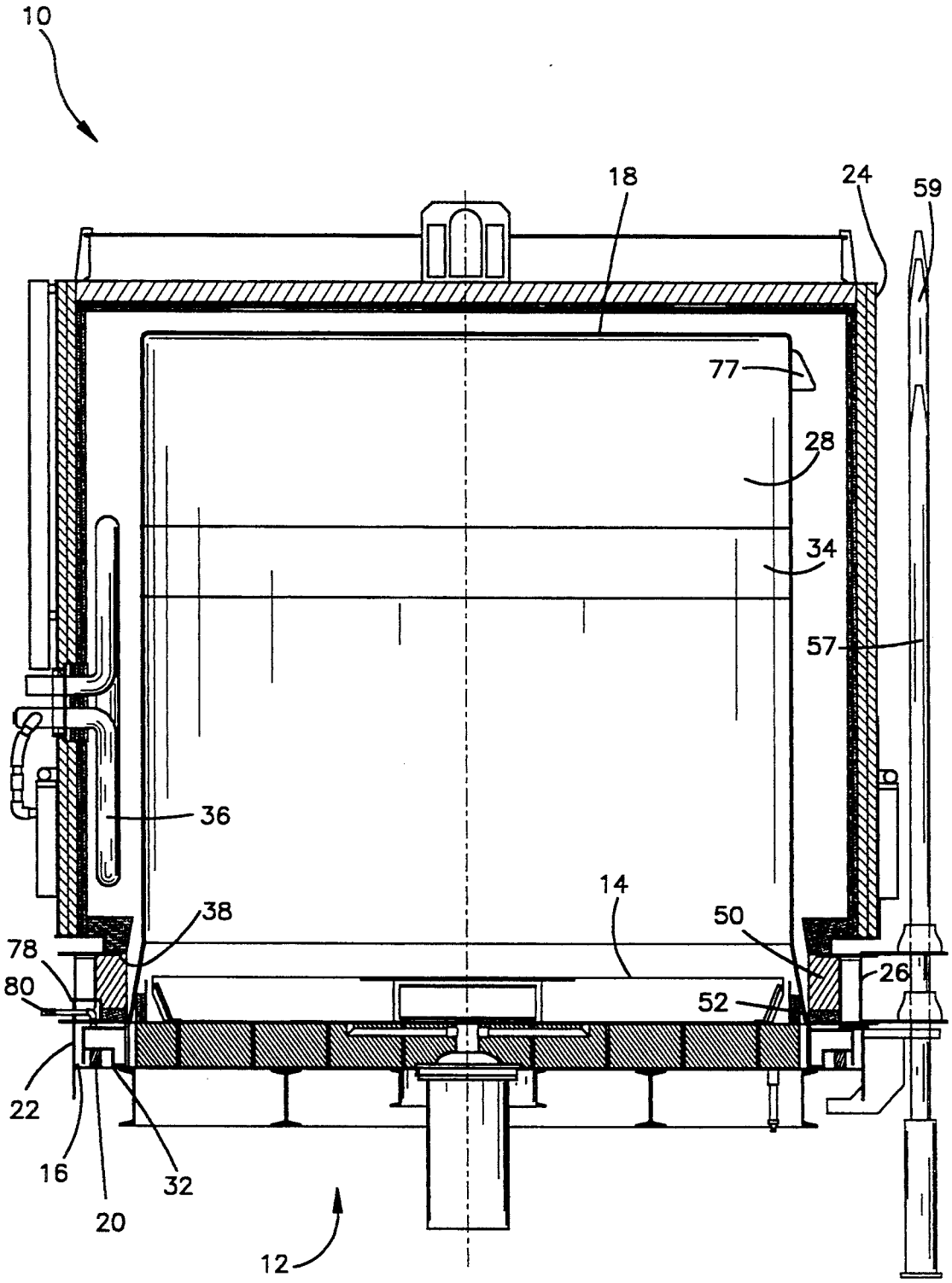
FIG. 1 is a sectional view, partially in section of a furnace installation employing a ring according to this invention.
Figure 2:
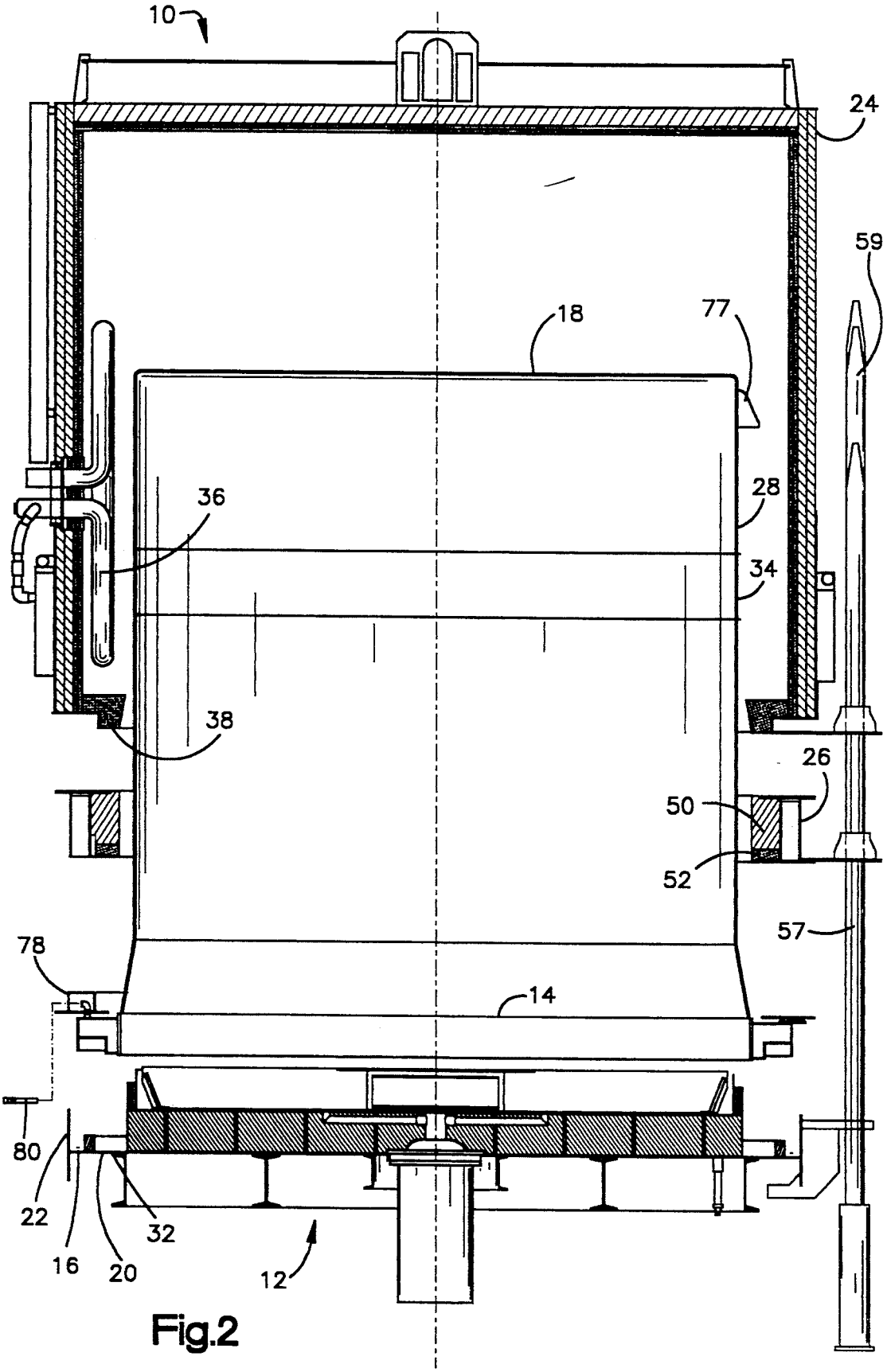
FIG. 2 is a partially exploded view of FIG. 1, showing the components of the furnace installation partially disassembled.

Referring now to the drawings, and for the present to FIGS. 1 and 2, a furnace installation 10 is shown which is comprised of a conventional base 12 including an upper surface 14 adapted to receive steel work pieces W such as steel rods or coils, and annular groove 16, adapted for receiving the inner cover 18. The annular groove 16 has disposed therein a seal member 20. The annular groove 16 is surrounded by annular rim 22 adapted to support furnace member 24 in conventional furnace installations, but which in the present inventions supports ring 26, as described hereinafter. Inner cover 18, is comprised of an upper dome 28, adapted to enclose work pieces W, and a flared lower portion 30, which has a water jacket 32 adapted to abut seal member 20 to provide a gas tight seal in a conventional manner.

In one aspect of the present invention inner cover 18 has been formed by modifying an existing conventional inner cover wherein the conventional inner cover was cut and an annular member 34 was inserted into the cut and welded to the pieces of the conventional inner cover to provide the extended height inner cover 18 of furnace installation 10.

The furnace installation 10 also includes a conventional furnace member 24, which can employ either electrical heating elements, flat flame burners or radiant tubes 36 for heating. The furnace member 24 is shaped and configured to enclose inner cover 18, and has bottom surface 38 which in conventional furnace installations rests on annular rim 22 of base 12. However, in the present invention, ring 26 is interposed between furnace member 24 and base member 12.

Figure 3:
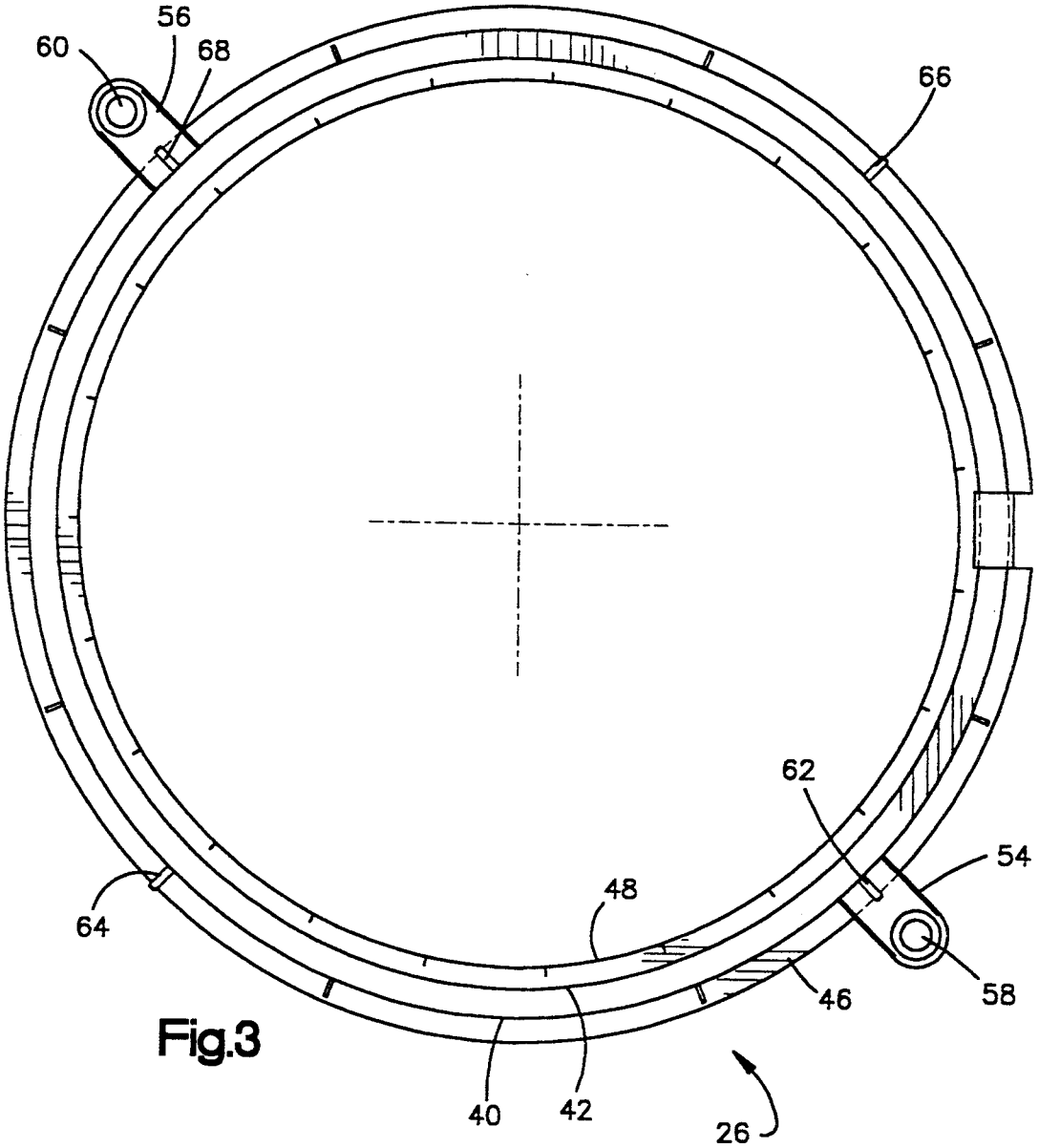
FIG. 3 is a plan view of the ring component of the furnace installation.
Figure 4:
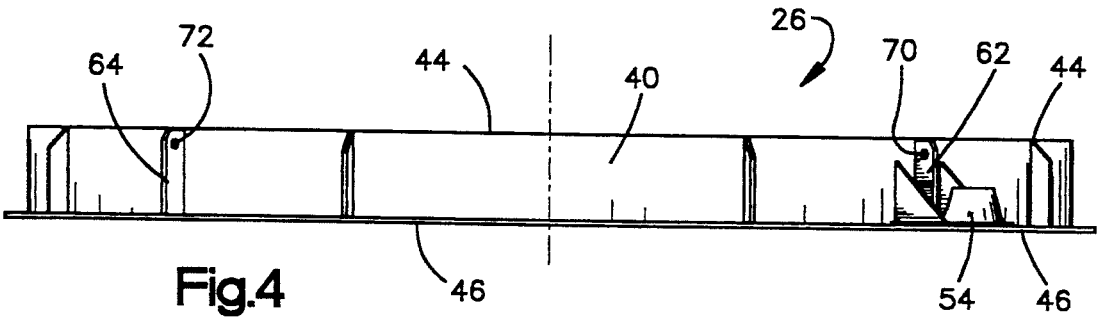
FIG. 4 is a side elevational view of the ring component of the present installation.

Referring to FIGS. 3 and 4, ring 26 has two annular vertical walls, outer wall 40 and inner wall 42 joined by top member 44 and bottom member 46. Top member 44 is flat and adapted to support furnace member 24. Bottom member 46 has a flat surface adapted to rest on rim 22.

Adjacent to and in contact with inner wall 42 is insulating collar 48. Referring to FIG. 1, insulating collar 48 is composed of heat insulating material. In the preferred embodiment, the insulating collar 48 is composed of a plurality of insulating ceramic modules 50. Suitable modules are available under the designation "Pyrobloc 'y' Modules," having a #10 density, 12 inch×6 inch×8 inch dimensions from Thermal Ceramics Corporation in Augusta, Ga. The modules 50 are mounted to the inner wall 42 using a stainless steel refractory anchor "H" configured mount pin bracket (not shown). The bracket is stud welded to the inner wall 42. Also adjacent inner wall 42 and disposed below modules 50 is blanket 52 of ceramic insulation; suitable insulation is available under the designation "KAO WOOL" from Thermal Ceramics Corporation in Augusta, Ga., in dimensions of 24 inches×1 inch×25 feet and having a 1 inch 8 pound density. The KAO WOOL is cut to dimensions of 5 ½ inches by 1 inch and the length is cut to fit the ring 26 dimensions. Three layers of KAO WOOL are positioned below modules 50 and are affixed to inner wall 42 with pins (not shown). The pins are welded to inner wall 42.

Preferably, ring 26 has at least one locating member such as locating guide arms 54 and 56 each of which has apertures such as guide holes 58 and 60 there through. The locating guide arms 54 coact with locating devices such as guide posts 57 and 59 to thereby radially position ring 26 on base 12. Referring to FIG. 4, in the preferred embodiment, ring 26 also has at least 4 liftings members 62, 64, 66, and 68 having holes 70, 72, 74 and 76 therethrough adapted to receive hooks for attachment to a lifting device such as a crane. In the preferred embodiment, inner cover 18 has lifting lugs 77 positioned for concomitant lifting of the inner cover 18 and ring 26.

As shown in FIGS. 1 and 2, a recessed portion of the ring 26 is adapted such as by recess 78 to permit access to external fittings such as the water tube 80 which is present in typical furnace installation.

When the ring 26 is in place, thermocouples (not shown) are repositioned in the same relationship to the furnace member 24 as before the ring was installed. (Note: as in any furnace installation, optimizing the location of the thermocouples may be necessary for maximum efficiency).

Figure 5:
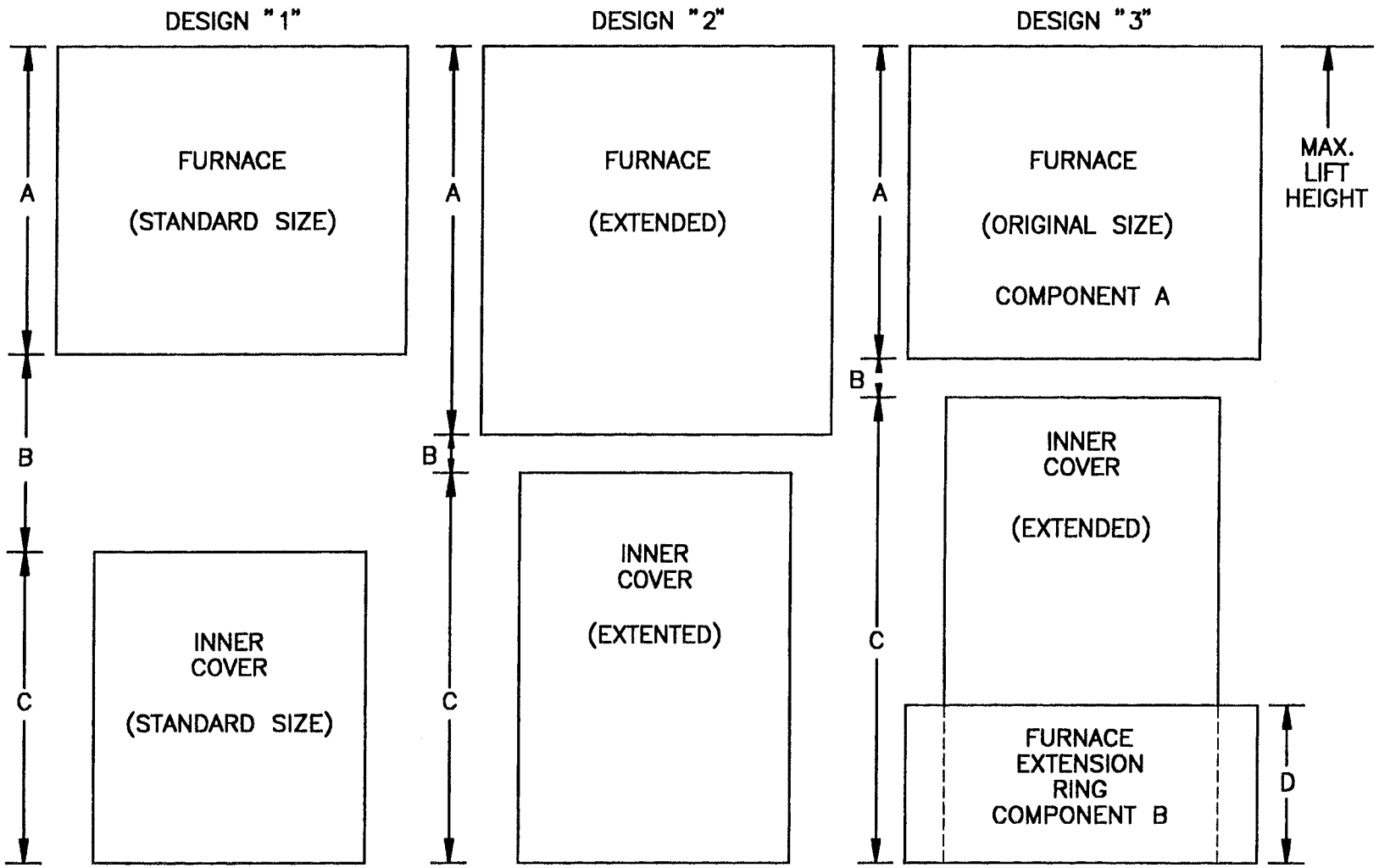
FIG. 5 is a graphical depiction demonstrating how the use of the ring in the furnace installation of this invention increases or maximizes furnace capacity.

As can be seen in FIG. 5 given a fixed ceiling height, by using the techniques of the present invention, i.e., employing a separate ring to increase the effective height of the furnace member twice the increase in heighth of the inner cover can be achieved in a given amount of space available above the furnace as could otherwise be achieved by physically increasing the height of the furnace member.

The calculation of the inner cover extension is discussed in reference to FIG. 5.

In FIG. 5, design 1 shows an existing inner cover and furnace cover confined by a ceiling or crane which is designated C. The maximum space available to a designer for increasing the furnace installation is designated "B". It is the space available between the bottom of the furnace member raised to ceiling and the top of the inner cover. In order to maintain a safe clearance distance B′ typically 6 inches, the practical maximum distance available to a designer is B—B′=X.

Without using the ring structure of the present invention, the inner cover could only be increased ½ X because the furnace member would have to be extended the same amount in order to enclose the inner cover. This is shown in design 2. It is not possible to extend both the inner cover and the furnace member by X because there would not be enough space above the inner cover in which to raise the furnace member; the furnace member would crash into the ceiling.

By employing the ring of the present invention as shown in design 3, the inner cover can be increased by X, rather than merely ½ X. Thus, the inner cover in design 3 may be extended twice the distance that the inner cover may be extended in design 2. That is the space B is devoted to increasing the inner cover. The ring in conjunction with the furnace member completely enclose the inner cover, and since the ring and the furnace member are separately removable, when the furnace member is lifted there is adequate space above the inner cover to accommodate the length of the furnace member so that it does not crash into the inner cover or the ceiling.

As a result of raising the furnace member, the heating tubes in the furnace member are shifted higher relative to the base. Moreover, the increased load of the furnace must be heated using the same number of radiant tubes. Accordingly, the heating cycles often need to be adjusted as compared to the conventional furnace heating cycles. Whether or not a heating cycle must be adjusted and the extent to which they must be adjusted depends, on the type of steel being heated, the type of furnace being modified, etc. Typically the length of heating time must be increased.

EXAMPLE 1

The spheroidizing cycle in an unmodified Radcon radiant tube furnace installation having a 132 inch base and a piling height of 108 inches for 4140 steel bar, rod, or coil, had a total cycle time of 37 hours. The amount of steel treated in the cycle was 50,400 pounds; the average pounds per hour was 1362 lbs./hour.

Subsequently, the furnace installation was modified according to the present invention to provide a Radcon radiant tube furnace installation having the same 132 inch base, an inner cover that was extended by 14.5 inches and a piling height of 124 inches. (The additional 4 inches of piling height was achieved by changing the top of the inner cover from a slant form to a horizontal form). The furnace installation also had ring 26. Ring 26 had a height of 14.5 inches, an inner diameter of 12 feet 8.5 inches, and outer diameter of 14 feet 9 inches. The total spheroidizing cycle time was increased to 41 hours, plus additional ramping time, which varies from load to load. The high soak time was increased by 3 hours. The amount of steel treated in the cycle was increased to 67,200 pounds; the average pounds per hour was increased to 1563 lbs./hour.

EXAMPLE 2

The spheroidizing cycle in an unmodified Radcon radiant tube furnace installation having a 132 inch base and a piling height of 108 inches for 15B35 steel coils, had a total cycle time of 32.5 hours. The amount of steel treated in the cycle was 50,400 pounds; the average pounds per hour was 1551 lbs./hour.

Subsequently, the furnace installation was modified as described in example 1. The total cycle time was increased to 38.5 hours, plus additional ramping time, which varies from load to load. The high soak time was increased by 4 hours. The amount of steel treated in the cycle was increased to 67,200 pounds; the average pounds per hour was increased to 1745 lbs./hour.

While the invention is described as a modification to existing radiant tube furnaces installations, the invention also applies to the other existing furnaces installations including open flame furnace installations, and to the production of new furnaces installations, particularly new furnaces installations which are to be installed in environments having limited space above the furnace.

What is claimed is:

1. A furnace installation comprising:

a base;

an inner cover adapted to detachably fit on Said base;

a ring adapted to detachably encircle a first portion of the inner cover and having a first surface adapted to detachably engage the base, and a spaced second surface;

a furnace member adapted to surround a second portion of the inner cover and detachably engage said second surface of the ring; and wherein the ring and the furnace member substantially enclose the inner cover when the inner cover is positioned on the base, the ring is positioned around the first portion of the inner cover and positioned on the base, and the furnace member is positioned on top of the ring surrounding the second portion of the inner cover.

2. The furnace installation of claim 1, wherein the ring further comprises a plurality of lifting members adapted to receive a lifting device.

3. The furnace installation of claim 1, wherein the ring further comprises at least one locating member, the locating member adapted to coact with a locating device adjacent said base to thereby radially position said ring on said base.

4. The furnace installation of claim 3, wherein the locating member is a locating arm having an aperture therein for coacting with the locating device.

5. The furnace installation of claim 1, wherein the ring further comprises insulation.

6. The furnace installation of claim 1, wherein the base further comprises an annular rim which defines an annular groove, said rim adapted to detachably engages said ring.

7. The furnace installation of claim 1, wherein the inner cover comprises a plurality of lifting lugs positioned for concomitant lifting of the inner cover and the ring.

8. The furnace installation of claim 1, wherein the ring includes a recessed portion for the reception of external connections.

9. The furnace installation of claim 1, wherein the ring further comprises; a plurality of lifting members adapted to receive lifting device, at least one locating arm, the locating arm having a an aperture disposed therein for coacting with a locating device adjacent said base to thereby radially position said ring on said base, a recessed portion for the reception of external connections, and insulation; said base further comprises an annular rim which defines an annular groove, said rim adapted to detachably engage said ring, and the inner cover further comprises a plurality of lifting lugs positioned for concomitant lifting of the inner cover and the ring.

10. A ring configured to surround a first portion of an inner cover and detachably supporting a furnace member surrounding an inner cover in a furnace installation;

said ring having insulation being configured to encircle a portion of said inner cover and comprising:

a first member adapted for detachably supporting said furnace member;

a second member adapted to detachably engage a base;

at least one wall member connected to said first member and to said second member;

wherein the furnace member when positioned on said ring is raised a predetermined distance from said base.

11. The ring of claim 10, wherein the ring further comprises a plurality of lifting members adapted to receive a lifting device.

12. The ring of claim 10, wherein the ring further comprises at least one locating member, the locating member adapted to coact with a locating device adjacent said base to thereby radially position said ring on said base.

13. The ring of claim 12, wherein the locating member is a locating arm having an aperture therein for coacting with the locating device.

14. The ring of claim 10, wherein the ring further comprises a plurality of lifting members adapted to receive lifting device, at least one locating arm, the locating arm having an aperature therein for coacting with a locating device adjacent said base to thereby radially position said ring on said base, a recessed portion for the reception of external connections, and insulation.

15. A method for increasing furnace installation capacity of a furnace installation having a base, an inner cover adapted to detachably fit on said base, a furnace member adapted to detachably enclose the inner cover and rest on said base, said method comprising the steps of:

a. increasing the height of the inner cover by a predetermined amount;

b. providing a ring having substantially the same height as the predetermined height in step a, said ring being configured to surround a portion of said inner cover and having a first surface adapted to detachably engage the base, and a second surface adapted to detachably support the furnace member, wherein the ring and the furnace member substantially enclose the inner cover when the inner cover is positioned on the base, the ring is positioned around the first portion of the inner cover and positioned on the base, and the furnace member is positioned on top of the ring surrounding the second portion of the inner cover.

16. The method of claim 15, wherein the ring further comprises a plurality of lifting members adapted to receive lifting device.

17. The method of claim 15, wherein the ring further comprises at least one locating member, the locating member adapted to coact with a locating device adjacent said base to thereby radially position said ring on said base.

18. The ring of claim 15, wherein the ring further comprises insulation.

19. The ring of claim 15, wherein the ring further comprises a plurality of lifting members adapted to receive a lifting device; at least one locating arm, the locating arm having an aperature therein for coacting with a locating device adjacent said base to thereby radially position said ring on said base; and insulation.

20. The method of claim 15, wherein the height of the inner cover is increased by adding an annular section to an existing inner cover that is shorter than the increased height by said predetermined amount.

* * * * *